US011787073B1

(12) United States Patent
Rexford

(10) Patent No.: US 11,787,073 B1
(45) **Date of Patent: *Oct. 17, 2023**

(54) SWITCH LOCK APPARATUS

(71) Applicant: Rexford Knives, LLC, Florissant, CO (US)

(72) Inventor: Todd Rexford, Florissant, CO (US)

(73) Assignee: Rexford Knives, LLC, Florissant, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/492,686

(22) Filed: Oct. 4, 2021

Related U.S. Application Data

(63) Continuation of application No. 16/255,556, filed on Jan. 23, 2019, now Pat. No. 11,135,730.

(60) Provisional application No. 62/621,531, filed on Jan. 24, 2018.

(51) Int. Cl.
*B26B 5/00* (2006.01)

(52) U.S. Cl.
CPC ..... *B26B 5/00* (2013.01)

(58) Field of Classification Search
CPC .. B26B 1/02; B26B 1/04; B26B 1/042; B26B 1/044; B26B 1/046; B26B 1/048; B26B 5/00
See application file for complete search history.

(56) References Cited

U.S. PATENT DOCUMENTS 3,942,249 A * 3/1976 Poehlmann ..... B26B 1/046 30/160
4,148,140 A * 4/1979 Lile ..... B26B 1/046 30/161
4,170,061 A * 10/1979 Henry ..... B26B 1/046 30/160
4,233,737 A * 11/1980 Poehlmann ..... B26B 1/046 30/344
4,541,175 A * 9/1985 Boyd ..... B26B 1/046 30/161
4,551,917 A * 11/1985 Walker ..... B26B 1/046 30/155
4,670,984 A * 6/1987 Rickard ..... B26B 1/046 30/161
4,750,267 A * 6/1988 Boyd ..... B26B 1/046 30/161
4,901,439 A * 2/1990 Boyd, Jr. ..... B26B 1/046 30/161
5,092,045 A * 3/1992 Boyd, Jr. ..... B26B 1/046 30/331

(Continued)

*Primary Examiner* — Jonathan G Riley
(74) *Attorney, Agent, or Firm* — Yiu F. Au; Au Law Office, P.C.

(57) ABSTRACT

A switch lock apparatus includes a top plate; an insert; a spring; a lock plate; and a bottom plate. The top plate and the bottom plate are rotationally fixably attached. The spring separates a top surface of the lock plate and a bottom surface of the top insert. The insert, the spring, and the lock plate are rotationally fixably attached. The bottom plate includes a space for lodging a portion of the lock plate. The lock plate is substantially rotationally fixably attached when the portion is lodged in the space. The lock plate is rotationally movable with respect to the bottom plate when the portion is not lodged in the space. The insert is attached to a blade portion of a knife. At least one of the top plate and the bottom plate is attached to a handle portion of the knife.

20 Claims, 16 Drawing Sheets

(56) References Cited

U.S. PATENT DOCUMENTS 6,826,836 B1 * 12/2004 Lin ..... B26B 1/048 30/155
6,868,760 B1 * 3/2005 Johnson ..... B25B 13/56 81/439
7,231,718 B2 * 6/2007 Outen ..... B26B 1/046 81/177.1
7,278,213 B2 * 10/2007 Pardue ..... B26B 1/04 30/159
8,413,338 B2 * 4/2013 Freeman ..... B26B 1/048 30/159
8,490,288 B1 * 7/2013 Mollick ..... B26B 1/046 30/158
8,499,460 B1 * 8/2013 Pearman ..... B26B 1/044 30/158
8,499,461 B1 * 8/2013 Mollick ..... B26B 1/046 30/160
8,646,184 B2 * 2/2014 Westerfield ..... B26B 1/046 30/155
8,707,564 B2 * 4/2014 Burch ..... B23D 51/01 30/158
8,978,253 B2 * 3/2015 Snyder ..... B26B 1/02 30/155
9,737,997 B1 * 8/2017 Marfione ..... B26B 1/04
9,878,455 B1 * 1/2018 Perez ..... B26B 1/00
10,131,059 B2 * 11/2018 Ikoma ..... B26B 1/042
10,144,139 B2 * 12/2018 Squiers ..... B26B 5/00
10,688,672 B1 * 6/2020 Perez ..... B26B 1/10
10,894,329 B1 * 1/2021 Mandeville ..... B26B 1/042
10,974,398 B2 * 4/2021 Onion ..... B26B 1/10
11,135,730 B1 * 10/2021 Rexford ..... B26B 1/046
2004/0158991 A1 * 8/2004 Freeman ..... B26B 1/048 30/161
2006/0277762 A1 * 12/2006 Knight ..... B26B 11/00 30/153
2007/0169354 A1 * 7/2007 Ralph ..... B26B 1/048 30/160
2008/0201953 A1 * 8/2008 Bremer ..... B26B 1/046 30/160
2009/0056146 A1 * 3/2009 Duey ..... B26B 1/048 30/159
2009/0241348 A1 * 10/2009 Westerfield ..... B26B 1/044 29/700
2011/0099817 A1 * 5/2011 Duey ..... B26B 1/02 30/159
2011/0162211 A1 * 7/2011 Maxey ..... B26B 1/044 30/155
2012/0023753 A1 * 2/2012 Wen ..... B26B 1/046 30/156
2012/0234142 A1 * 9/2012 Onion ..... B26B 1/044 30/155
2012/0304470 A1 * 12/2012 Freeman ..... B26B 1/046 30/159
2013/0047439 A1 * 2/2013 Hawk ..... B26B 1/04 30/160
2013/0263455 A1 * 10/2013 Collins ..... B26B 1/044 29/896.9
2014/0047718 A1 * 2/2014 Fellows ..... B26B 1/02 30/161
2015/0239134 A1 * 8/2015 Duey ..... B26B 1/06 30/159
2015/0343650 A1 * 12/2015 Valdez ..... B26B 1/044 30/158
2015/0352730 A1 * 12/2015 Duey ..... B26B 1/048 30/159
2016/0067803 A1 * 3/2016 Kohl ..... B26B 1/044 30/161
2016/0075037 A1 * 3/2016 Ikoma ..... B26B 1/046 30/161
2017/0144316 A1 * 5/2017 Trull ..... B25G 1/00
2017/0167172 A1 * 6/2017 Jelbert ..... B26B 1/04
2017/0341243 A1 * 11/2017 Sheahan ..... B25F 1/006
2019/0184584 A1 * 6/2019 Duey ..... B26B 1/048
2019/0366566 A1 * 12/2019 Harsey ..... B26B 1/044
2020/0047358 A1 * 2/2020 Ikoma ..... B26B 1/042
2021/0107172 A1 * 4/2021 Onion ..... B26B 1/046

* cited by examiner

SWITCH LOCK APPARATUS

CROSS REFERENCE TO RELATED APPLICATIONS

The present application is a continuation of U.S. patent application Ser. No. 16/255,556 (patented as U.S. Pat. No. 11,135,730), which claims the benefits of and priority, under 35 U.S.C. § 119(e), to U.S. Provisional Application Ser. No. 62/621,531, filed Jan. 24, 2018; the above-identified applications are fully incorporated herein by reference.

BACKGROUND OF THE INVENTION

Field of the Invention

The present invention generally relates to a switch lock apparatus, and more particularly to an adaptable switch lock apparatus for folding knives.

Description of the Related Art

There are folding knives in the related art.

U.S. Pat. No. 4,170,061 to Henry, herein incorporated by reference, discloses "an adequate sizing skinning blade for big game, etc., with the capability of being safely locked whether in the open position for use or in the folded position for carrying, providing the maximum overall length of cutting edge but providing a more compact and convenient size for carrying in one's pocket or on one's person."

There are deficiencies in the related art. For example, foldable knives may include more complicated modifications to the blade and/or handle materials in order to accommodate the foldable function. Accordingly, this may negatively affect the manufacturing process, production costs, materials that can be used for the blade and/or the handle, and other deficiencies.

SUMMARY OF THE INVENTION

Accordingly, the invention is directed to an adaptable switch lock apparatus that substantially obviates one or more of the problems due to limitations and disadvantages of the related art.

An advantage of an embodiment is to provide simplicity and interchangeability of parts to the production and manufacturing process, and robustness and additional strength to the knife, among other advantages.

Additional features and advantages of the invention set forth in the description which follows and in the art will be apparent from the description, or may be learned by practice of the invention. The objectives and other advantages of the invention will be realized and attained by the structure particularly pointed out in the written description and claims hereof as well as the appended figures.

In an embodiment, a switch lock apparatus includes a top plate; an insert; a spring; a lock plate; and a bottom plate. The top plate and the bottom plate are rotationally fixably attached. The spring separates a top surface of the lock plate and a bottom surface of the top insert. The insert, the spring, and the lock plate are rotationally fixably attached. The bottom plate includes a space for lodging a portion of the lock plate. The lock plate is substantially rotationally fixably attached when the portion is lodged in the space. The lock plate is rotationally movable with respect to the bottom plate when the portion is not lodged in the space. The insert is attached to a blade portion of a knife. At least one of the top plate and the bottom plate is attached to a handle portion of the knife. The switch lock apparatus further includes a button. The button is rotationally fixably attached to the bottom plate. The button is operable to dislodge the portion from the space. In a rotational configuration, the insert is substantially rotationally fixed to the top plate. In the rotational configuration, the portion is not lodged in the space. In a second rotational configuration between the insert and the top plate, the insert is not rotationally fixed to the top plate. The rotational configuration is movable to the second rotational configuration through an application of a force by a hand of a user. The switch lock apparatus further includes a second spring and a bearing lodged in a second space of the insert. In the rotational configuration, the bearing is lodged in a third space of the top plate. The switch lock apparatus further includes a second insert rotationally fixably attached to the top plate, the bottom plate, and the button and a second spring between the button and the second insert. The switch lock apparatus further includes first and second sets of one or more bearings, wherein the first set facilitate rotation between the top plate and the insert, and wherein the second set facilitate rotation between the bottom plate and the insert. The portion comprises a protrusion.

In another embodiment, a folding knife includes a blade portion; a handle portion; and a switch lock mechanism. The switch lock mechanism includes a top plate; an insert; a spring; a lock plate; and a bottom plate. The top plate and the bottom plate are rotationally fixably attached. The spring separates a top surface of the lock plate and a bottom surface of the top insert. The insert, the spring, and the lock plate are rotationally fixably attached. The bottom plate includes a space for lodging a portion of the lock plate. The lock plate is substantially rotationally fixably attached when the portion is lodged in the space. The lock plate is rotationally movable with respect to the bottom plate when the portion is not lodged in the space. The insert is attached to the blade portion. At least one of the top plate and the bottom plate is attached to a handle portion of the knife. The switch lock mechanism further comprises a button. The button is rotationally fixably attached to the bottom plate. The button is operable to dislodge the portion from the space. In a rotational configuration, the insert is substantially rotationally fixed to the top plate. In the rotational configuration, the portion is not lodged in the space. In a second rotational configuration between the insert and the top plate, the insert is not rotationally fixed to the top plate. The rotational configuration is movable to the second rotational configuration through an application of a force by a hand of a user. The switch lock mechanism further includes a second spring and a bearing lodged in a second space of the insert. In the rotational configuration, the bearing is lodged in a third space of the top plate. The switch lock mechanism further includes a second insert rotationally fixably attached to the top plate, the bottom plate, and the button and a second spring between the button and the second insert. The switch lock mechanism further includes first and second sets of one or more bearings. The first set facilitate rotation between the top plate and the insert. The second set facilitate rotation between the bottom plate and the insert. The portion comprises a protrusion. In the rotational configuration, the blade portion is in an open position with respect to the handle portion. When the portion is lodged in the space, the blade portion is in a closed position with respect to the handle portion.

In yet another embodiment, a folding knife includes a blade portion; a handle portion; and a switch lock mechanism. The switch lock mechanism includes a top plate; an insert; a spring; a lock plate; a second insert; a second spring; a button; and a bottom plate. The top plate and the bottom plate are rotationally fixably attached. The spring separates a top surface of the lock plate and a bottom surface of the top insert. The insert, the spring, and the lock plate are rotationally fixably attached. The bottom plate includes a space for lodging a portion of the lock plate. The lock plate is substantially rotationally fixably attached when the portion is lodged in the space. The lock plate is rotationally movable with respect to the bottom plate when the portion is not lodged in the space. The button is rotationally fixably attached to the bottom plate. The button is operable to dislodge the portion from the space. The second insert rotationally fixably attached to the top plate, the bottom plate, and the button and the second spring between the button and the second insert. The insert is attached to the blade portion. At least one of the top plate and the bottom plate is attached to a handle portion of the knife.

It is to be understood that both the foregoing general description and the following detailed description are exemplary and explanatory and are intended to provide further explanation of the invention as claimed.

The phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It shall be understood that the term "means," as used herein, shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible, utilizing, alone or in combination, one or more of the features set forth above or described in detail below.

BRIEF DESCRIPTION OF THE FIGURES

The accompanying figures, which are included to provide a further understanding of the invention, are incorporated in and constitute a part of this specification, illustrate embodiments of the invention and together with the description serve to explain the principles of the invention.

DETAILED DESCRIPTION

Reference will now be made in additional detail to an embodiment of the present invention, example of which is illustrated in the accompanying figures.

Figure 1A:
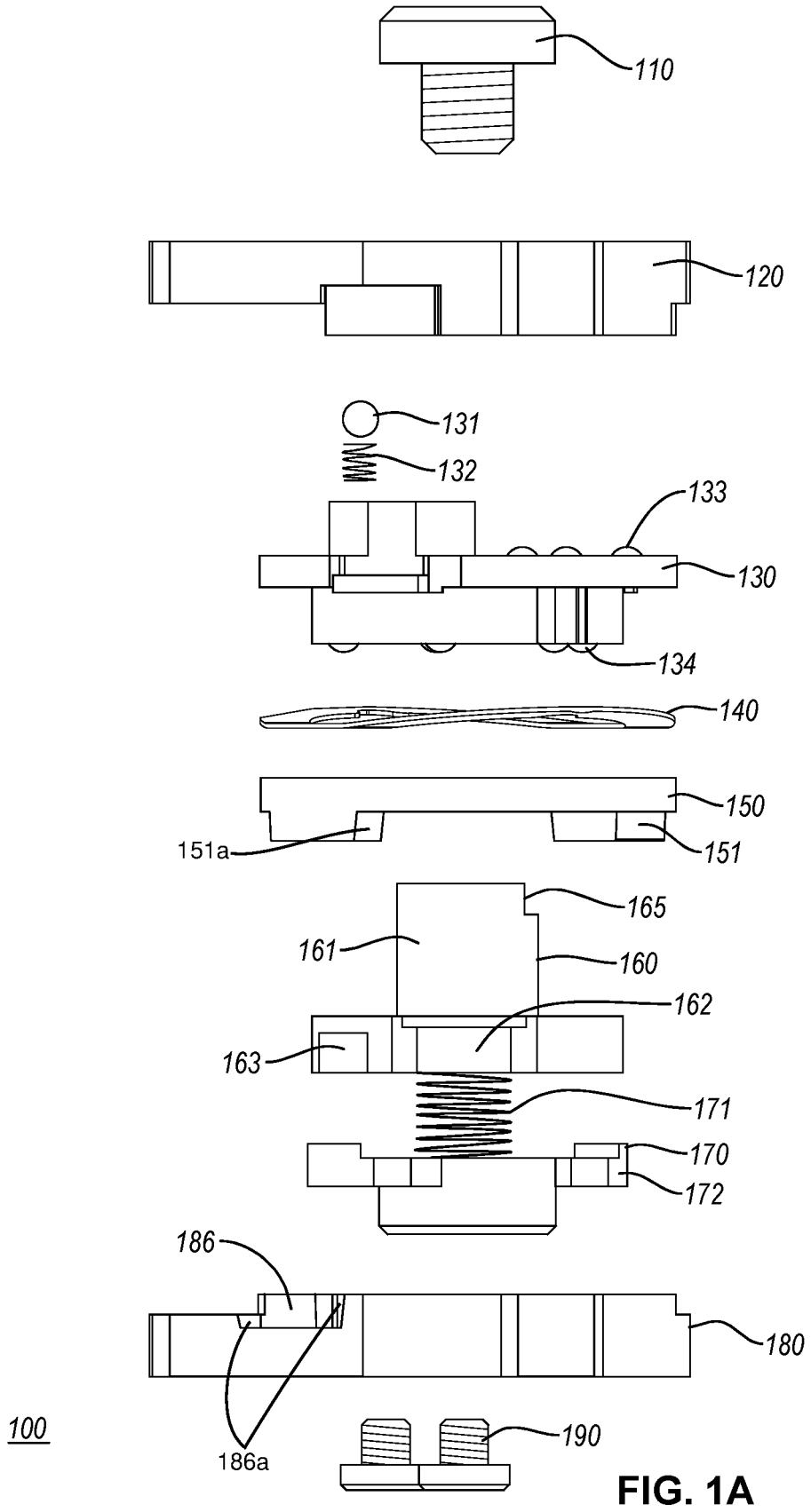
FIG. 1A illustrates an exploded side view of an exemplary switch lock apparatus according to an embodiment.
Figure 1B:
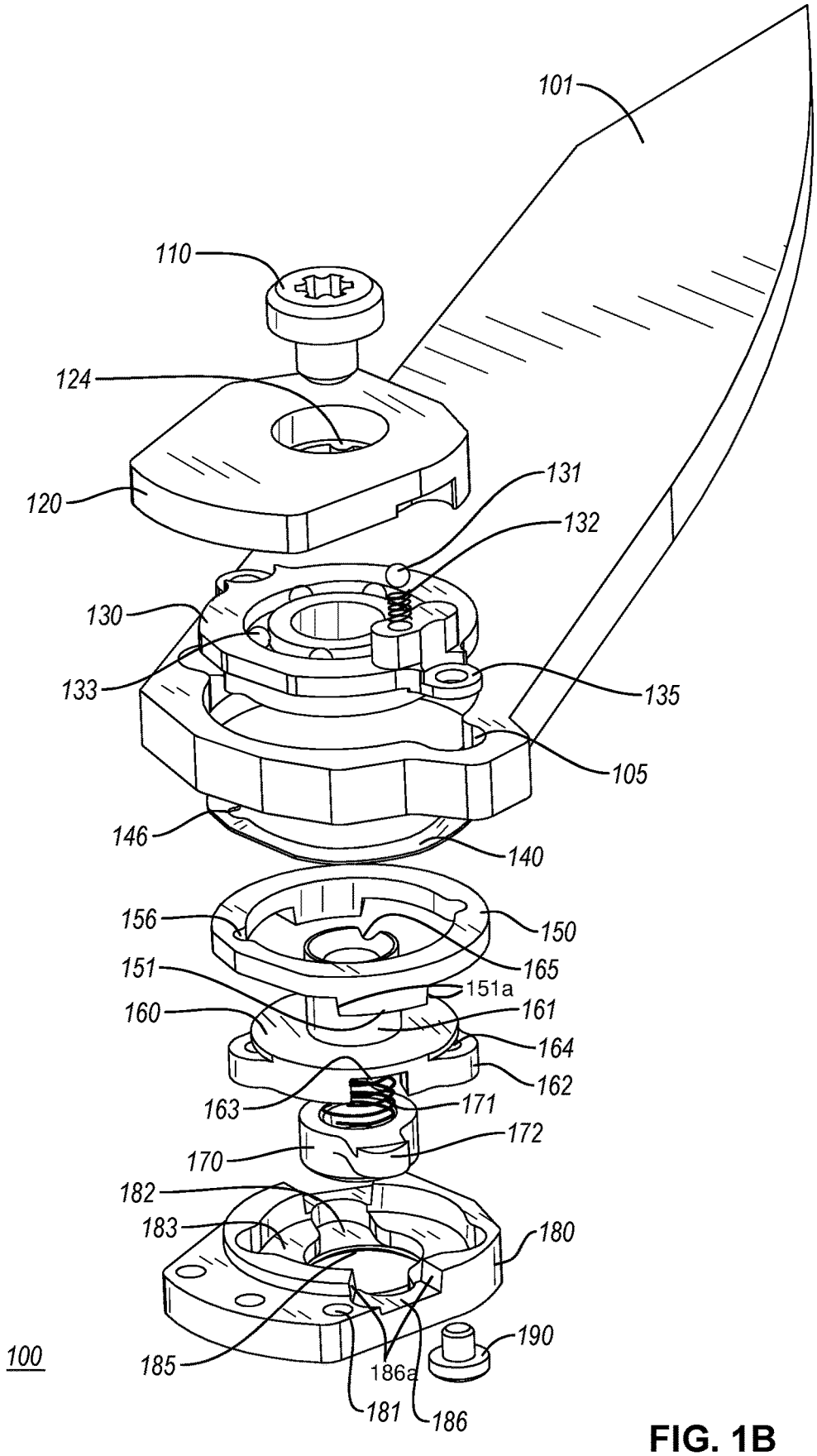
FIGS. 1B and 1C illustrate exploded perspective views of the switch lock apparatus.
Figure 1C:
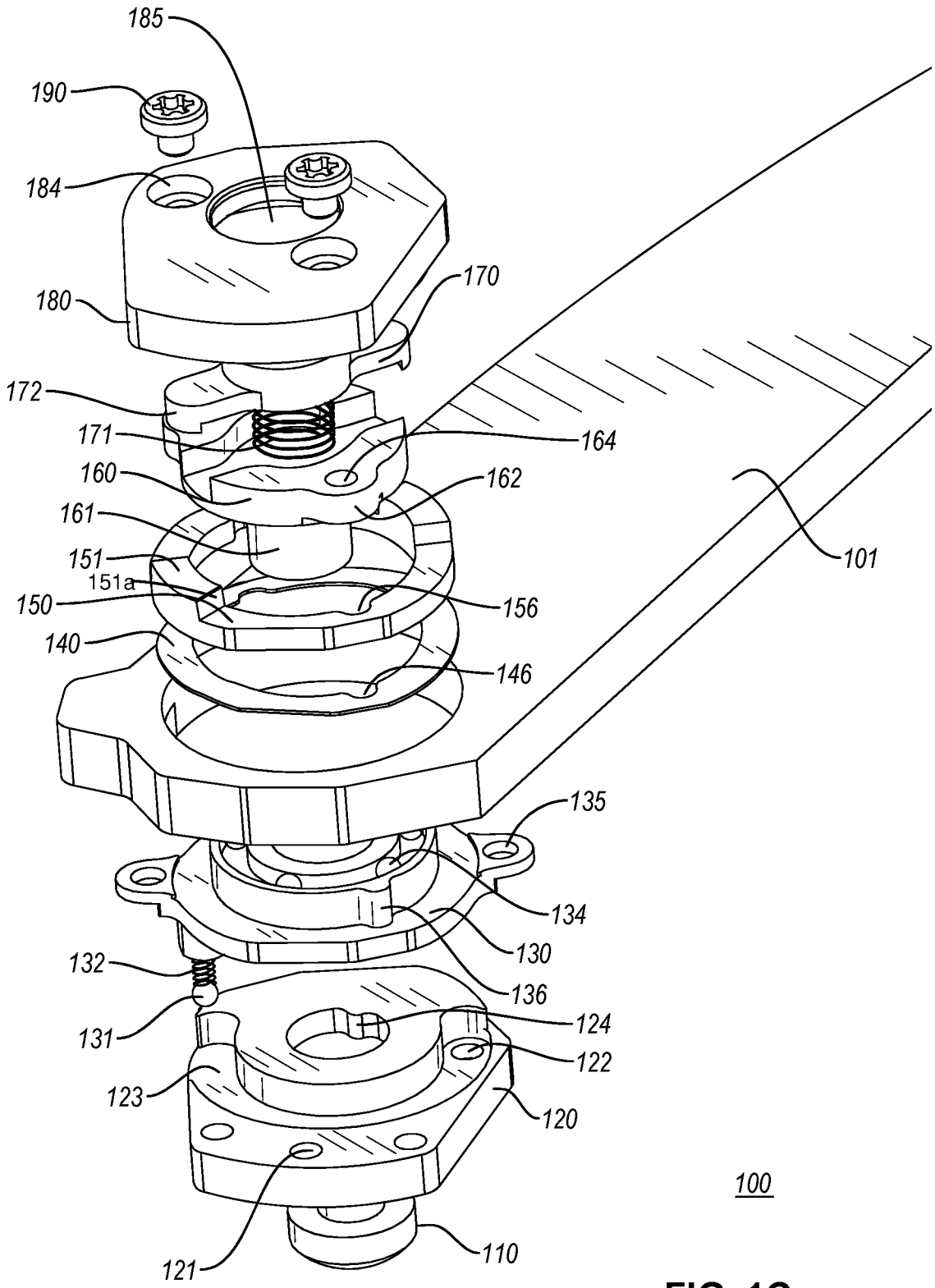
Figure 2A:
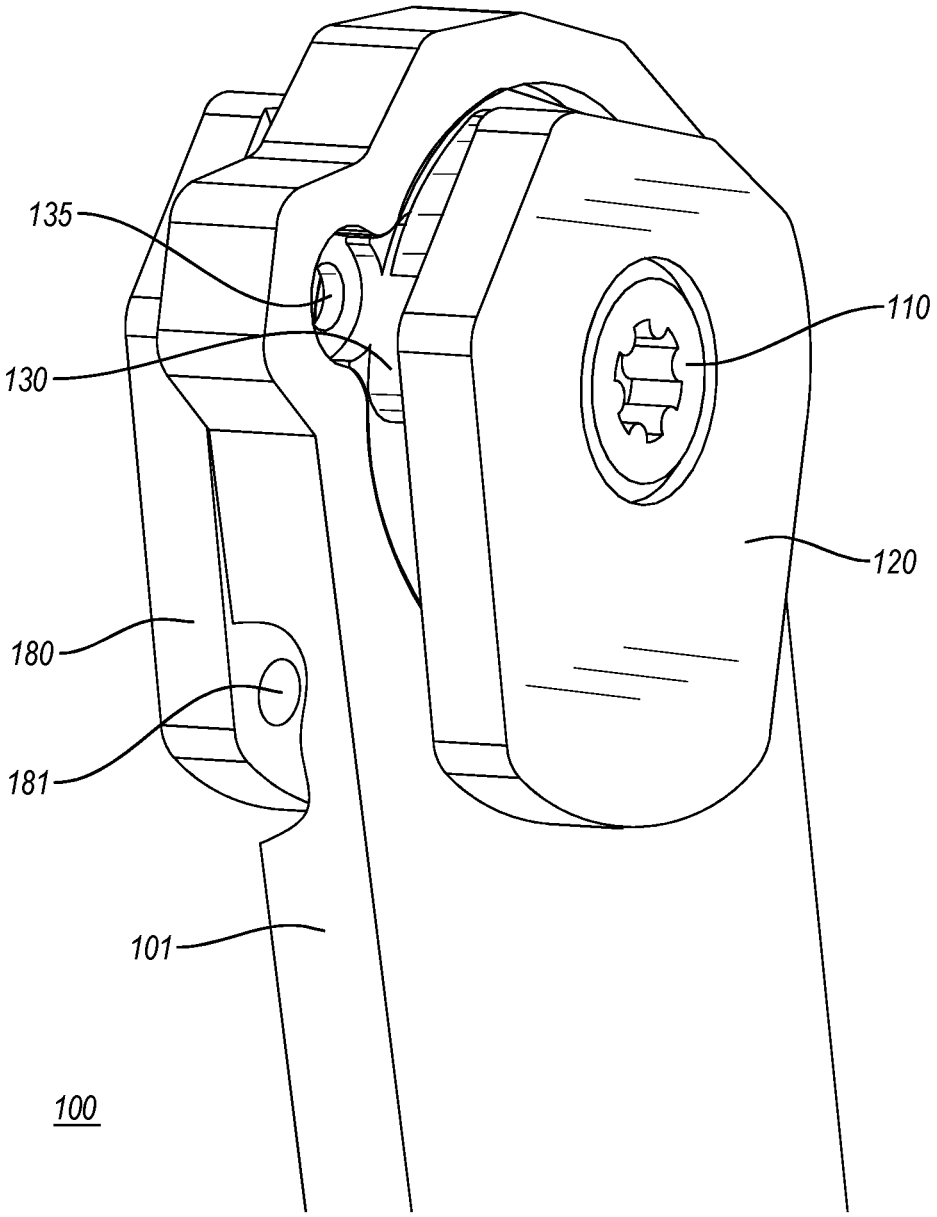
FIGS. 2A-2D illustrate views of the switch lock apparatus in a closed blade position according to an embodiment.
Figure 2B:
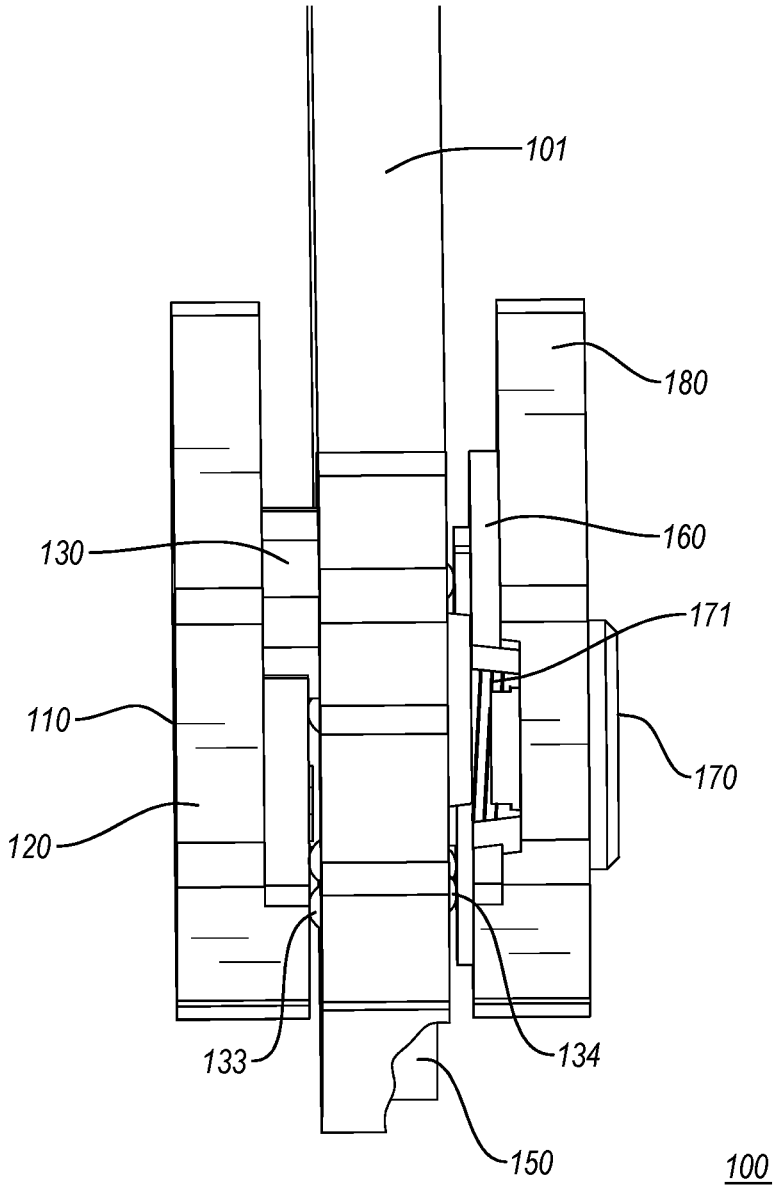
Figure 2C:
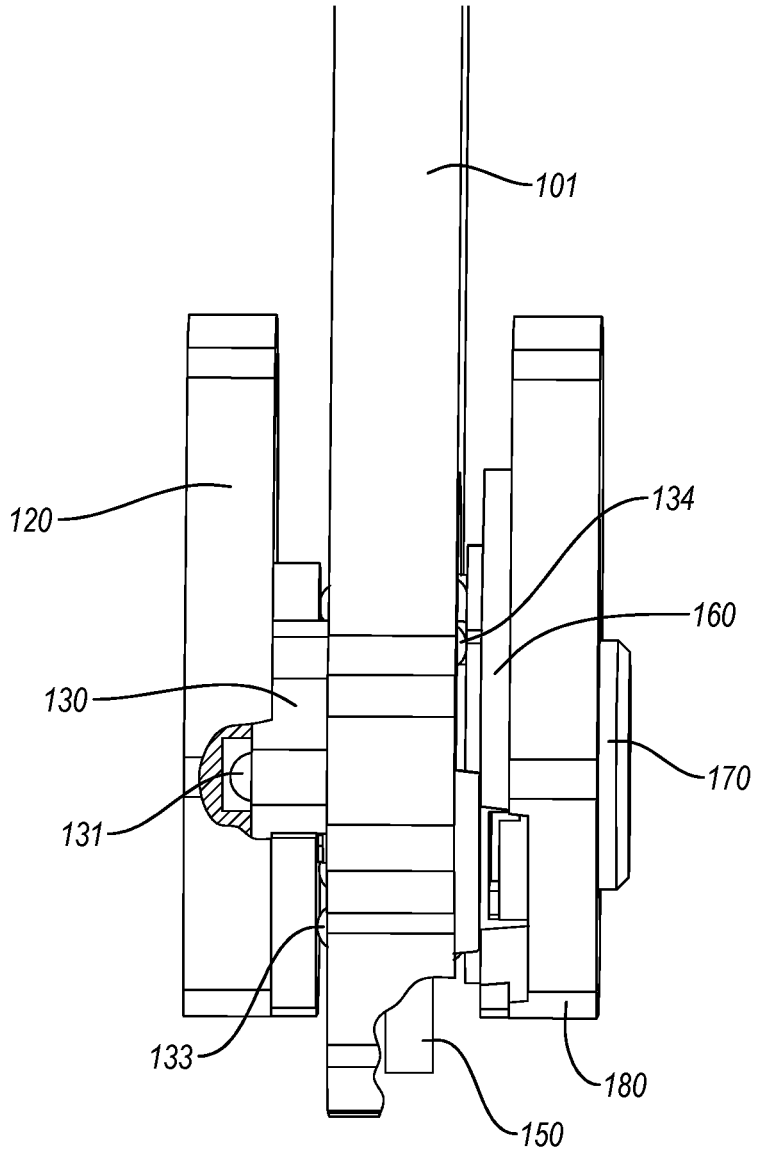
Figure 2D:
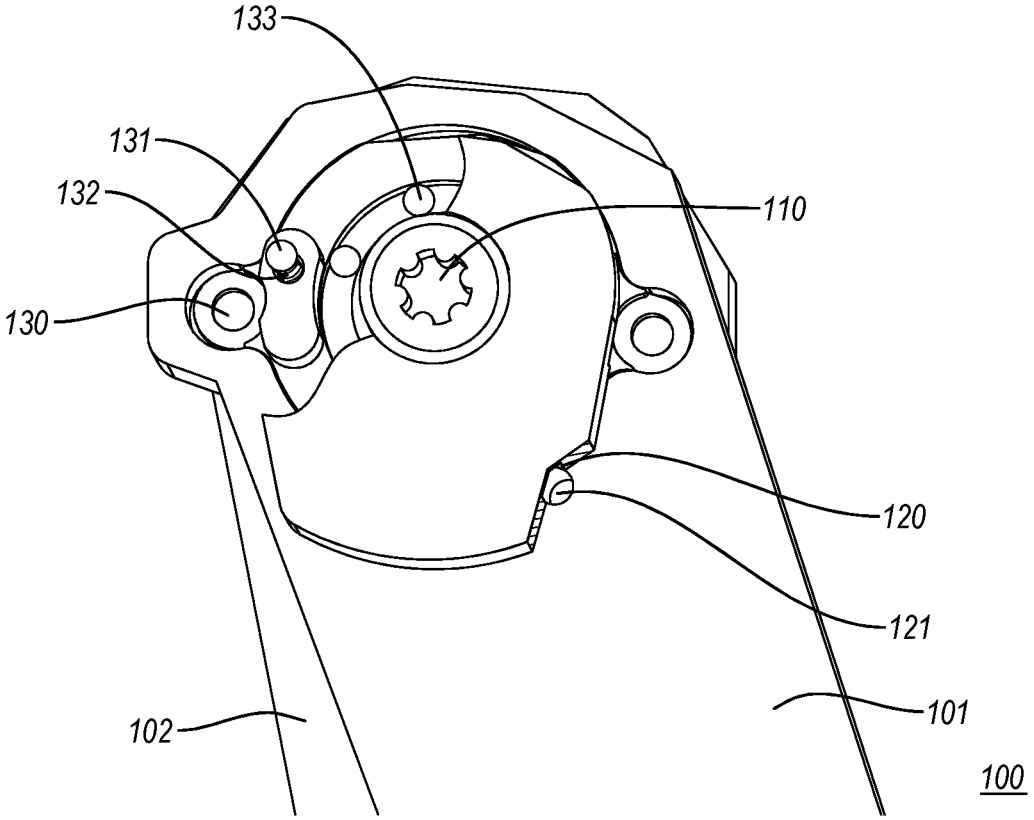

FIG. 1A illustrates an exploded side view of an exemplary switch lock apparatus according to an embodiment. FIGS. 1B and 1C illustrate exploded perspective views of the switch lock apparatus.

According to an embodiment, the switch lock apparatus 100 may include one or more of detent insert plate 120, blade insert 130, main spring 140, lock plate 150, lock insert 160, button 170, female lock plate 180, screws 110 and 190, detent ball 131, and ball bearings 133 and 134.

In an embodiment, the switch lock apparatus 100 may be configured to attach to a blade 101 and handle portions 102 of a knife for providing switch lock functionality to the knife. In an embodiment, the switch lock apparatus 100 may be fitted into an opening in the blade 101 for providing the switch lock functionality when the switch lock apparatus 100 is also attached to the handle portions 102. For example, the blade insert 130 may be attached to the blade 101 via screws (or other attachments) through screw openings 135 and 105; detent insert plate may be attached to a half of the handle portion 102 via screws (or other attachments) through attachment openings 121; and female lock plate 180 may be attached to another half of the handle portion 102 via screws (or other attachments) through attachment openings 181. When the switch lock apparatus 100 is assembled (e.g., from top-to-bottom via screws 110 and 190) with the attached blade 101 and handle portions 102, the switch lock apparatus 100 may function as a switch lock for turning the blade 101 and the handle portions 102 of a knife between a closed position (e.g., where a cutting edge of the blade 101 at least partially enclosed by the handle portions 102) and open position (e.g., where a cutting edge of the blade 101 released from the handle portions 102 for use). In an embodiment, the blade 101 and the handle portions 102 are not a part of the switch lock apparatus 100 and do not provide the switch lock functionality (other than being attached to the switch lock apparatus 100). Accordingly, the switch lock apparatus 100 provides advantages such as simplicity and interchangeability of parts to the production and manufacturing process, and robustness and additional strength to the knife, among other advantages.

In an embodiment, the switch lock apparatus 100 may be assembled on a knife (e.g., a combination of blade 101 and handle portions 102) as follows.

An opening at an end of the blade 101 may be configured to fit the blade insert 130 (and other components of the assembled switch lock apparatus 100) and be attached with the blade insert 130 through the screw openings 135 and 105

(or by other attachments). The blade insert 130 includes a number of ball bearings 134 arranged in a track at one side of the blade insert 130.

The blade insert 130 may be inserted through the main spring 140 and the lock plate 150 (e.g., with the protrusions 136 substantially matching the grooves 146 of the main spring 140 and the grooves 156 of the lock plate 150). In an embodiment, it is noted that the blade insert 150 cannot substantially rotate independently with respect to the main spring 140 and the lock plate 150 due to the protrusions 136 and the grooves 146 and 156 being matched.

Pressed to the side of the blade insert 130 with the ball bearings 134 is a side of the lock insert 160. The protruded screw receptor 161 may be inserted through the space in the lock insert 130. The lock insert 160 may further include indents 163 that are matched with protrusions 172 on the button 170. The button 170 is separated from the lock insert 160 by spring 171. When the button is pushed towards the lock insert 160 (e.g., through an application of force on the button 170 by a user when the switch lock apparatus 100 is in a certain configurations), the protrusions 172 may fit into the indents 163.

The female lock plate 180 includes, at one side, attachment openings 181 for attachment to a half of handle portion 102 and includes indent 182 for fitting protrusions 172 of the button 170 (e.g., when the button is pushed by the uncompressed spring 171 into the indents 182) and indents 183 for fitting the lock insert 160 with the protrusions 162. The top portion of the button 170 (e.g., for being able to be pushed by a user) fits through the opening 185 to the other side of the female lock plate 140. The other side of the female lock plate 140 includes screw openings 184 for inserting screws 190. The screws 190 further attaches to screw openings 164 of the lock insert 160.

In an embodiment, the female lock plate 180 further includes indents 186, which may be matched with the protrusions 151 of the lock plate 150 for fitting the protrusions 151. In an embodiment, the edges 151*a* of the protrusions 151 are tapered. In an embodiment, the edges 186*a* of the indents 186 are tapered. In the relatively uncompressed state, the main spring 140 pushes against the lock plate 150 with enough force to fit the protrusions 151 into the indents 186 through the relatively uncompressed thickness of the main spring 140. While the protrusions 151 are fitted into the indents 186, the blade insert 130 (and the blade 101 that is attached to the blade insert 130) could not substantially rotate independently from the female lock plate 180 (e.g., due to the protrusions 151 being blocked by the sides of the indents 186 to move laterally (rotationally), and the blade insert 130 cannot substantially rotate independent of the lock plate 150). If the lock plate 150 (and the protrusions 151) can be vertically lifted from the indents 186, then the lock plate 150 (and the blade insert 130) may move laterally (rotationally) independent of the female lock plate 180. When the button 170 is pressed, the protrusions 151 may be pushed vertically from the indents 186 (e.g., by the protrusions 172, which are fitted in the indents 183 when the button 170 is in the uncompressed position), which also relatively compresses the main spring 140. In an embodiment, when the button 170 is pressed, the protrusions 172 may be fitted into indents 163, which may substantially prevent the button 170 from being able to be substantially rotated independent of lock insert 160.

In an embodiment, the main spring 140 is sufficiently resilient to push the protrusions 151 into the indents 186 even after wear to the protrusions 151 and/or the indents 186 (e.g., when the protrusions 151 and/or the indents 186 wear down in usage over time such that the protrusions 151 is smaller and/or the indents 186 is deeper, at which the main spring 140 may need further resiliency to push the protrusions 151 into the indents 186 as compared to pre-wearing down). In an embodiment, the main spring 140 may be made of a spring of a standard heat-treated spring stock $^{12}/_{1000}$ in thickness.

The detent insert plate 120 includes, at one side, attachment openings 121 for attachment to another half of the handle portion 102. The detent insert plate 120 further includes a track 123 for the sliding of ball bearings 133 along the track 123, when the blade insert 130 rotates with respect to the detent insert plate 120 (e.g., when the blade 101, which is attached to the blade insert 130, rotates with respect to the handle portion 102, which is attached to the detent insert plate 120). In an embodiment, the track 123 may have a limited ranged (e.g., to limit the rotational range of the blade insert 130 with respect to the detent insert plate 120). In an embodiment, the detent insert plate 120 may include a detent ball retain opening 122 near an end of the track 123 for retaining the detent ball 131 (e.g., to provide a detent or catch mechanism when the rotation of the blade insert 130 with respect to the detent insert plate 120 reaches the limit of the track 123 in one direction). The detent ball 131 is fitted to a mount on blade insert 130 with a detent spring 132 in between the blade insert 130 and the detent ball 131, where the detent spring 132 pushes against the detent ball 131 on the track 123 and the detent ball retain opening 122.

In an embodiment, the ball bearings 133 may include be loose ball bearings (e.g., machined-in races and balls) or may be caged ball bearings (e.g., a caged bearing insert fitted to the space in the blade insert 130) or other types of bearings and/or bearings assemblies as known now or may be later derived. In standard manufacturing, it may be preferable to use a caged bearing insert.

In an embodiment, the protruded screw receptor 161 may be further inserted through the detent insert plate 120 to receive the screw 110 from the other side of the detent insert plate 120 for attachment.

In an embodiment, the space in the detent insert plate 120 where the protruded screw receptor 161 includes a protrusion 124 that matches a corresponding groove 165 in the protruded screw receptor. This may function to limit the rotational independence of detent insert plate 120 and lock insert 160. Further, since the female lock plate 180 is substantially fixed to the lock insert 160 through the screws 190, the rotational independence of the detent insert plate 120 and female lock plate 180 may also be limited even if the handle portions 102 are not attached to the detent insert plate 120 and female lock plate 180. It is noted that the detent insert plate 120 and female lock plate 180 would not typically rotate independently when the handle portions 102 are respectively attached (e.g., because the handle portions 102 are typically from the same piece). In an embodiment, the mechanisms to control the rotational independence of the detent insert plate 120 and female lock plate 180 facilitate in the consistent and smooth transfer of force when the switch lock apparatus is rotated by the user, which may provide robustness and prevent early wearing of parts, among other advantages. In an embodiment, it is noted that the blade insert 130 (which is attached to the blade 101), the main spring 140, and the lock plate 150 may rotate substantially independently from the detent insert plate 120 and female lock plate 180, within limits of the switch lock apparatus 100 (e.g., the track 123 and/or the protrusion 151).

In an embodiment, the outer contour of the detent insert plate 120 and female lock plate 180 may follow the contour of the handle portions 102 (e.g., the curves of the handle portions 102) for aesthetics, ease of handling, or other purposes.

FIGS. 2A-2D illustrates views of the switch lock apparatus in a closed blade position according to an embodiment.

FIGS. 2A-2D are illustrated with certain portions of certain components of the switch lock apparatus 100 cut-out (as indicated in the drawings by shading and/or recess showing the cut-out) to show other components that may be hidden. The handle portions 102 are not shown (e.g., as attached to the detent insert plate 120 and the female lock plate 180 in a fully assembled switch lock apparatus 100 on a knife) in FIGS. 2A-2C.

In a closed blade position (e.g., an end position where the blade 101 is at least partially enclosed by the handle portions 102), the blade insert 130 is rotated with respect to the detent insert plate 120 along track 123 to a position where the detent ball 131 can be retained into detent ball retain opening 122. The detent ball 131 is held to being retained into the detent ball retain opening 122 by detent spring 132 unless disturbed by a sufficient force. When a sufficient force (e.g., pulling of the blade 101 by the user) is applied to rotate the blade insert 130 along the open direction of the track 123, the detent ball 131 may be pushed out of the detent ball retain opening 122 (e.g., through a compression of the detent spring 132) for moving the switch lock apparatus 100 towards an open blade position.

In an embodiment, the detent spring 132 may be spring of about 20 in lb of force.

Figure 3A:
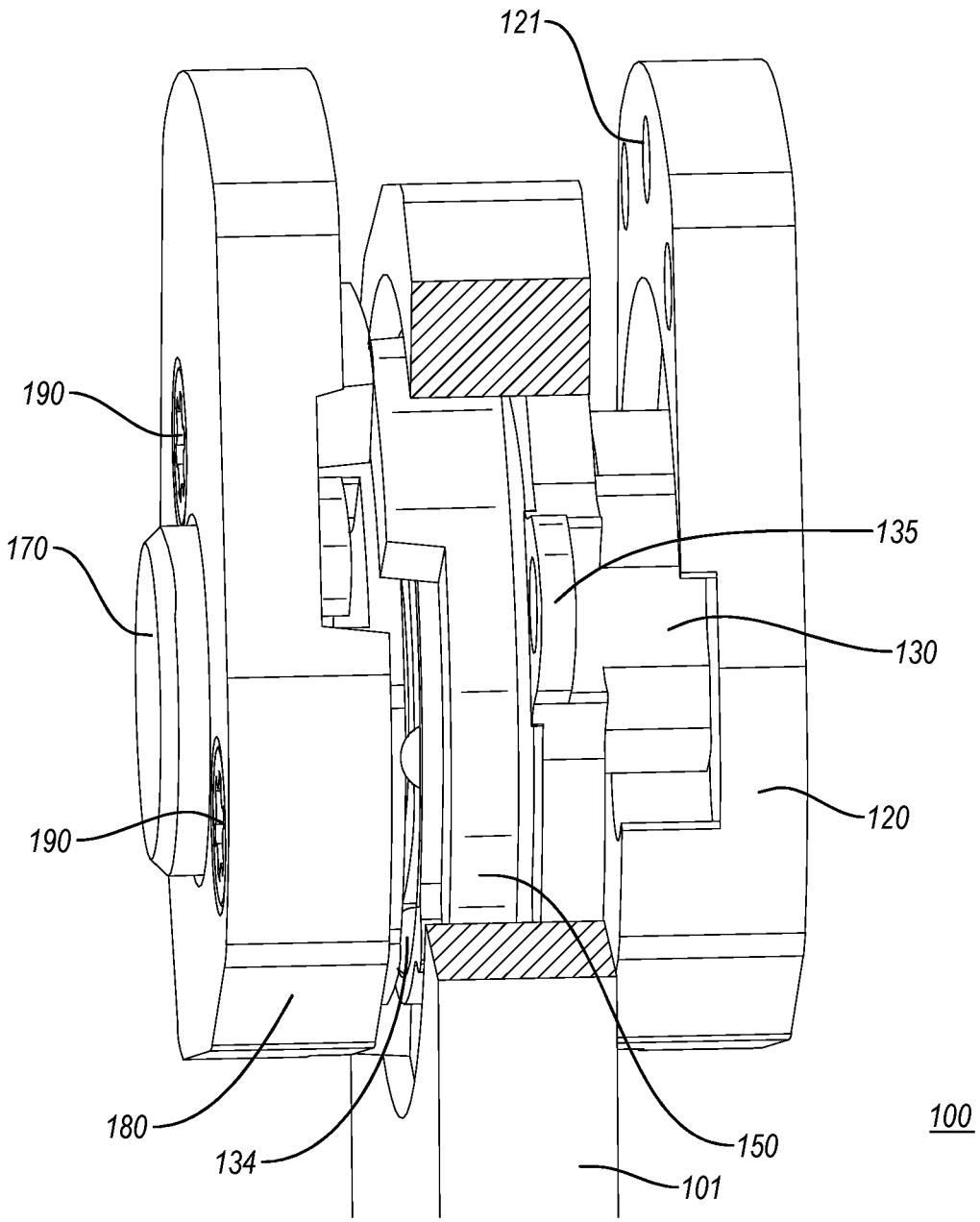
FIGS. 3A-3C illustrate views of the switch lock apparatus in transition between closed and open blade positions according to an embodiment.
Figure 3B:
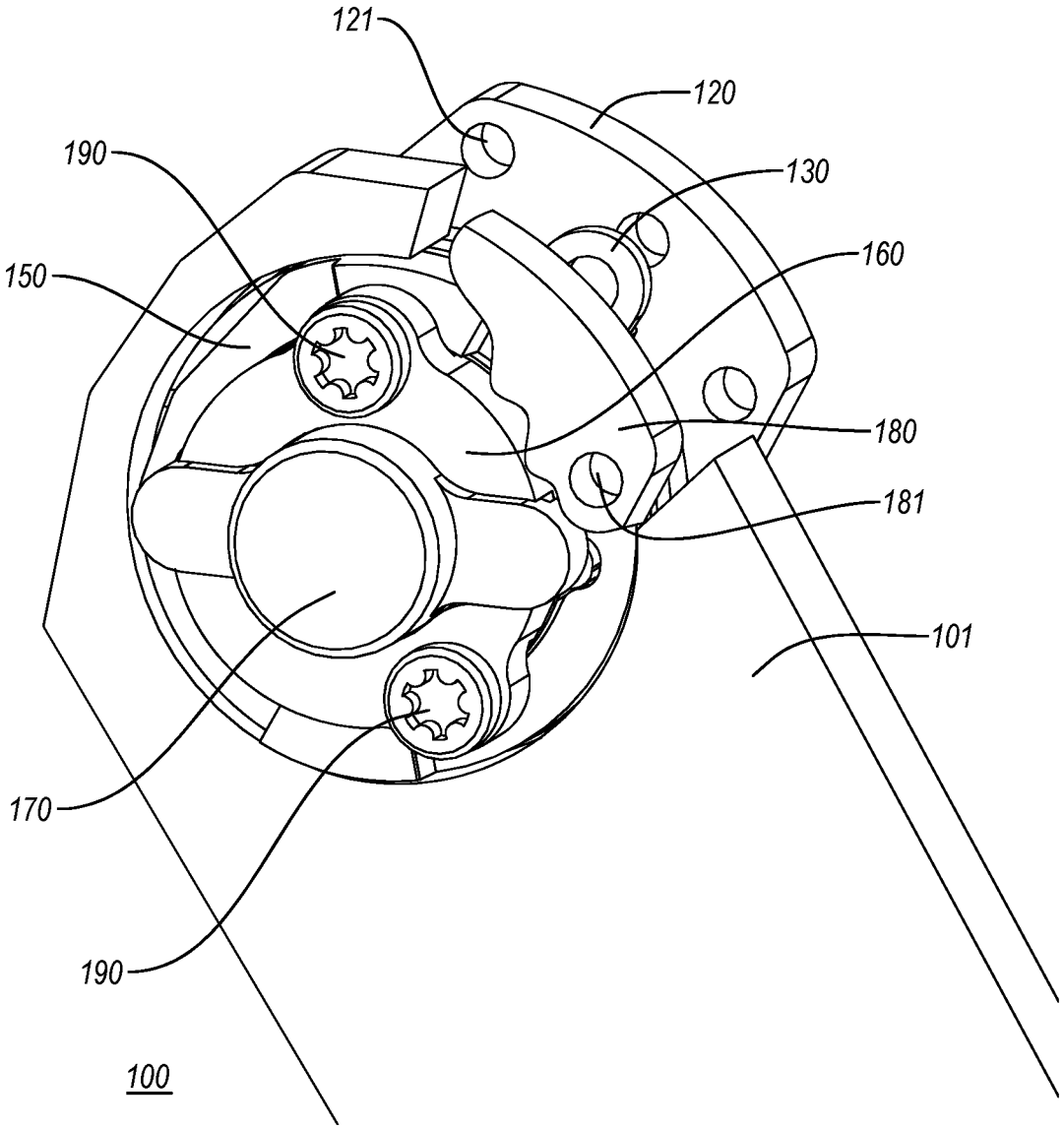
Figure 3C:
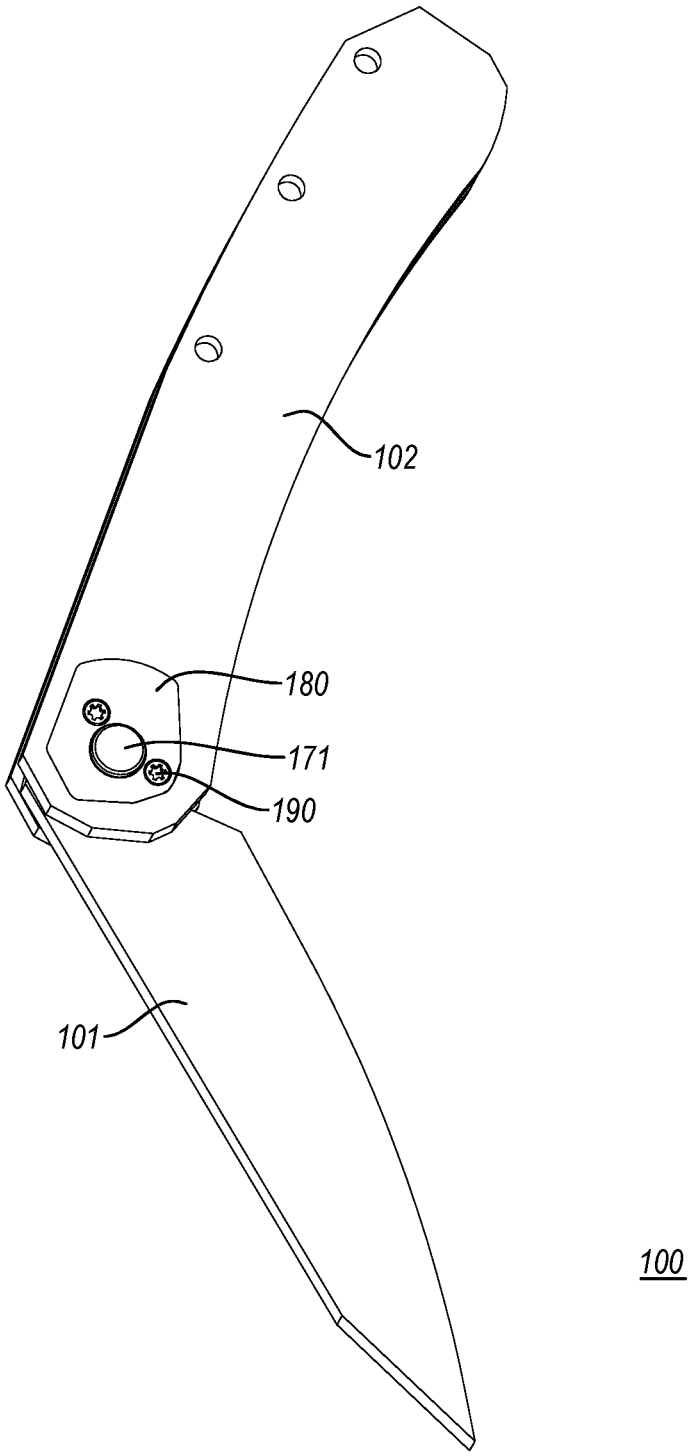

FIGS. 3A-3C illustrate views of the switch lock apparatus in transition between closed and open blade positions according to an embodiment.

FIGS. 3A-3C are illustrated with certain portions of certain components of the switch lock apparatus 100 cut-out (as indicated in the drawings by shading and/or recess showing the cut-out) to show other components that may be hidden. The handle portions 102 are not shown (e.g., as attached to the detent insert plate 120 and the female lock plate 180 in a fully assembled switch lock apparatus 100 on a knife) in FIGS. 3A-3B.

As the blade 101 is rotated from the closed blade position to the open blade position, the detent ball 131 rotationally slide along the track 123. Similarly, the ball bearings 133 and 134 rotationally slides along respective surfaces on the blade insert 130 and the lock insert 160.

Figure 4A:
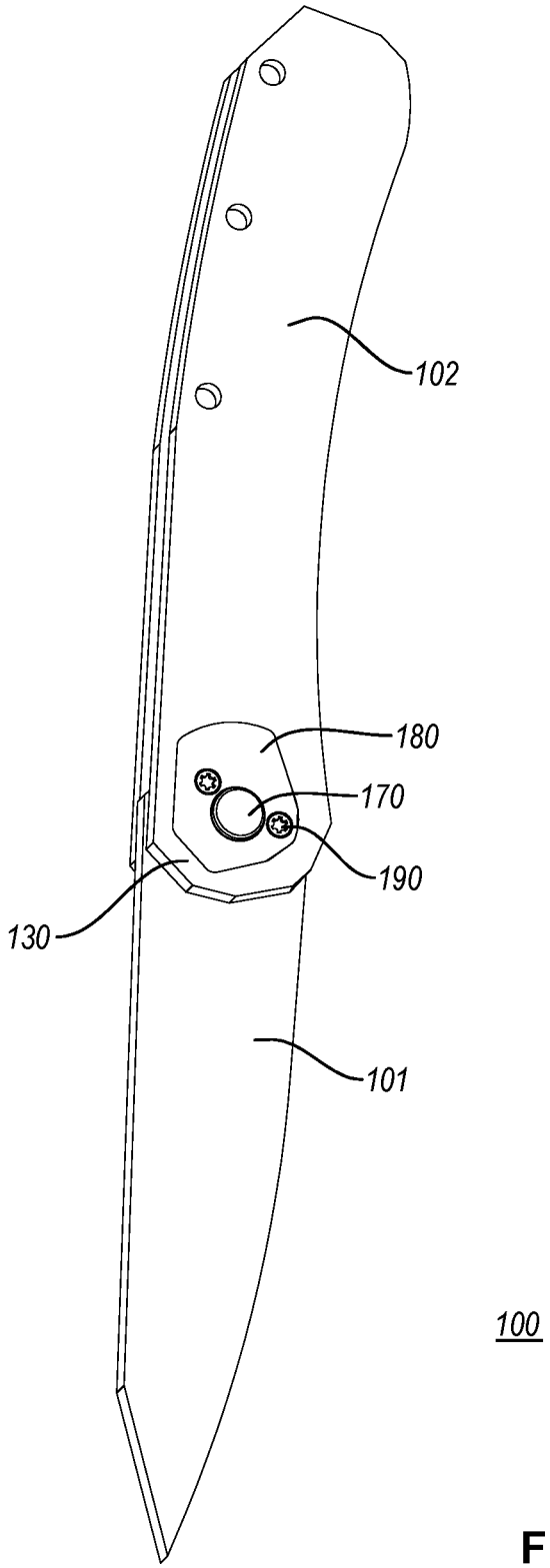
FIGS. 4A-4C illustrate views of the switch lock apparatus in an open blade position according to an embodiment.
Figure 4B:
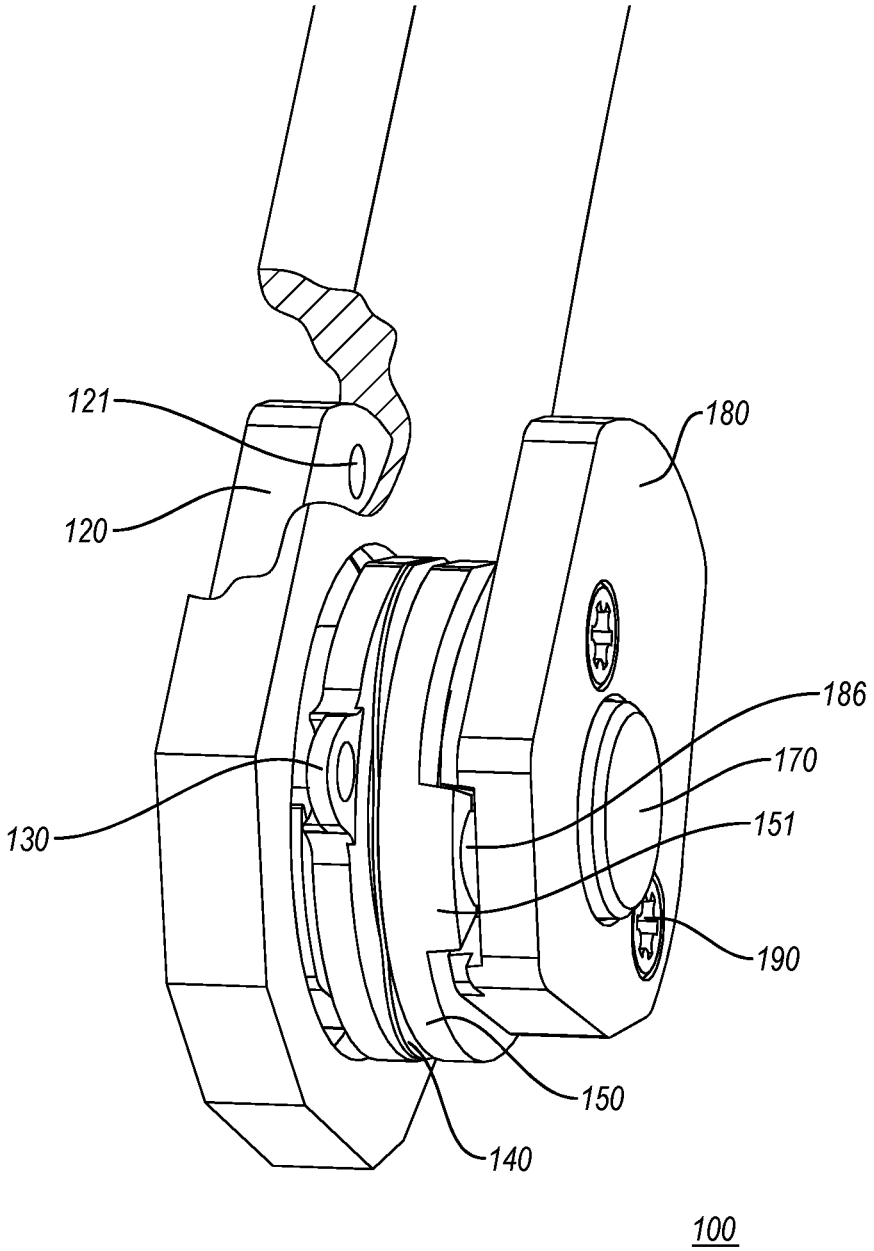
Figure 4C:
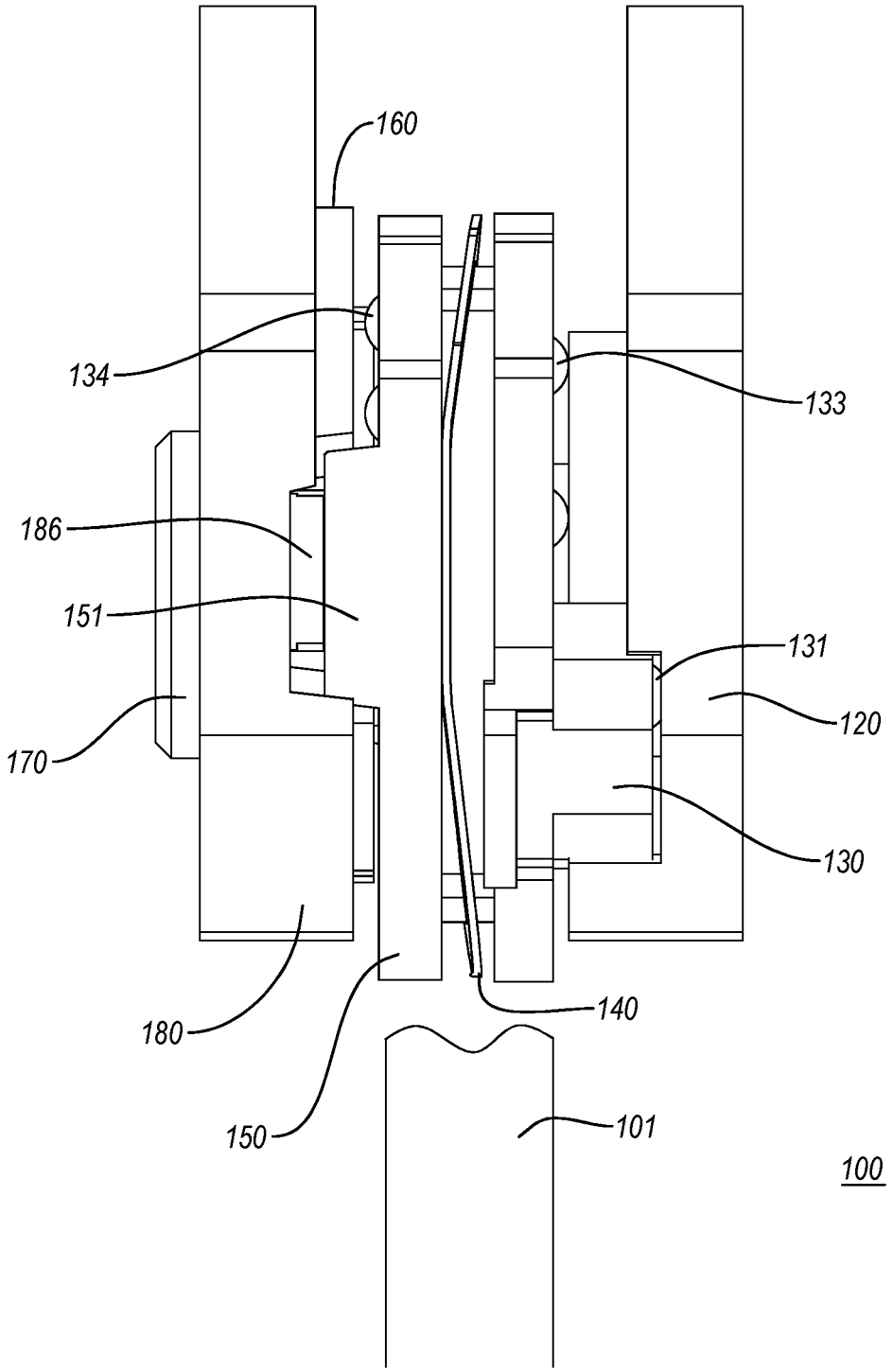

FIGS. 4A-4C illustrate views of the switch lock apparatus in an open blade position according to an embodiment.

FIGS. 4A-4C are illustrated with certain portions of certain components of the switch lock apparatus 100 cut-out (as indicated in the drawings by lines showing the cut-out) to show other components that may be hidden. The handle portions 102 are not shown (e.g., as attached to the detent insert plate 120 and the female lock plate 180 in a fully assembled switch lock apparatus 100 on a knife) in FIGS. 4B-4C.

In the open blade position, the detent ball 131 is stopped near an end of the track 123 opposite from the detent ball retain opening 122. The lock plate 150 is rotated (with the blade insert 130) to a position that aligns with the indents 186, and the protrusions 151 are pushed into the indents 186 by the main spring 140 (which are now in a relatively uncompressed state). When the protrusions 151 are pushed into the indents 186, the lock plate 150 (and the blade insert 130) is in a locked position as the protrusions 151 are laterally blocked by the walls of the indents 186 and cannot rotate into a less open blade position.

In an embodiment, the angle between the blade 101 and the handle portions 102 for a knife may be pre-determined and pre-adjusted based on the length of the rotational track 123 and/or the position of the protrusions 151 and the indents 186.

Figure 5A:
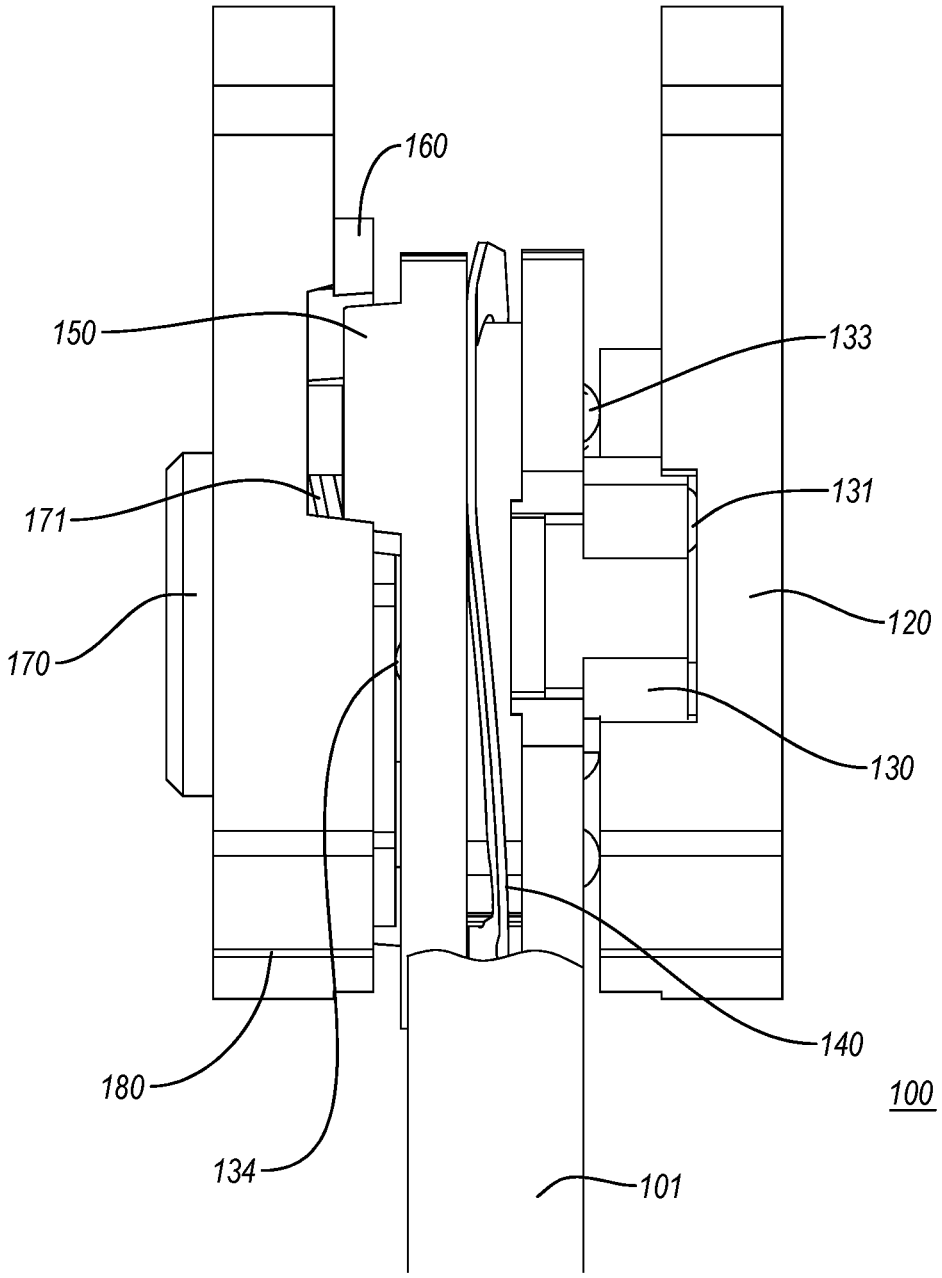
FIGS. 5A-5C illustrate views of the switch lock apparatus in an open blade position with a button pushed-in according to an embodiment.
Figure 5B:
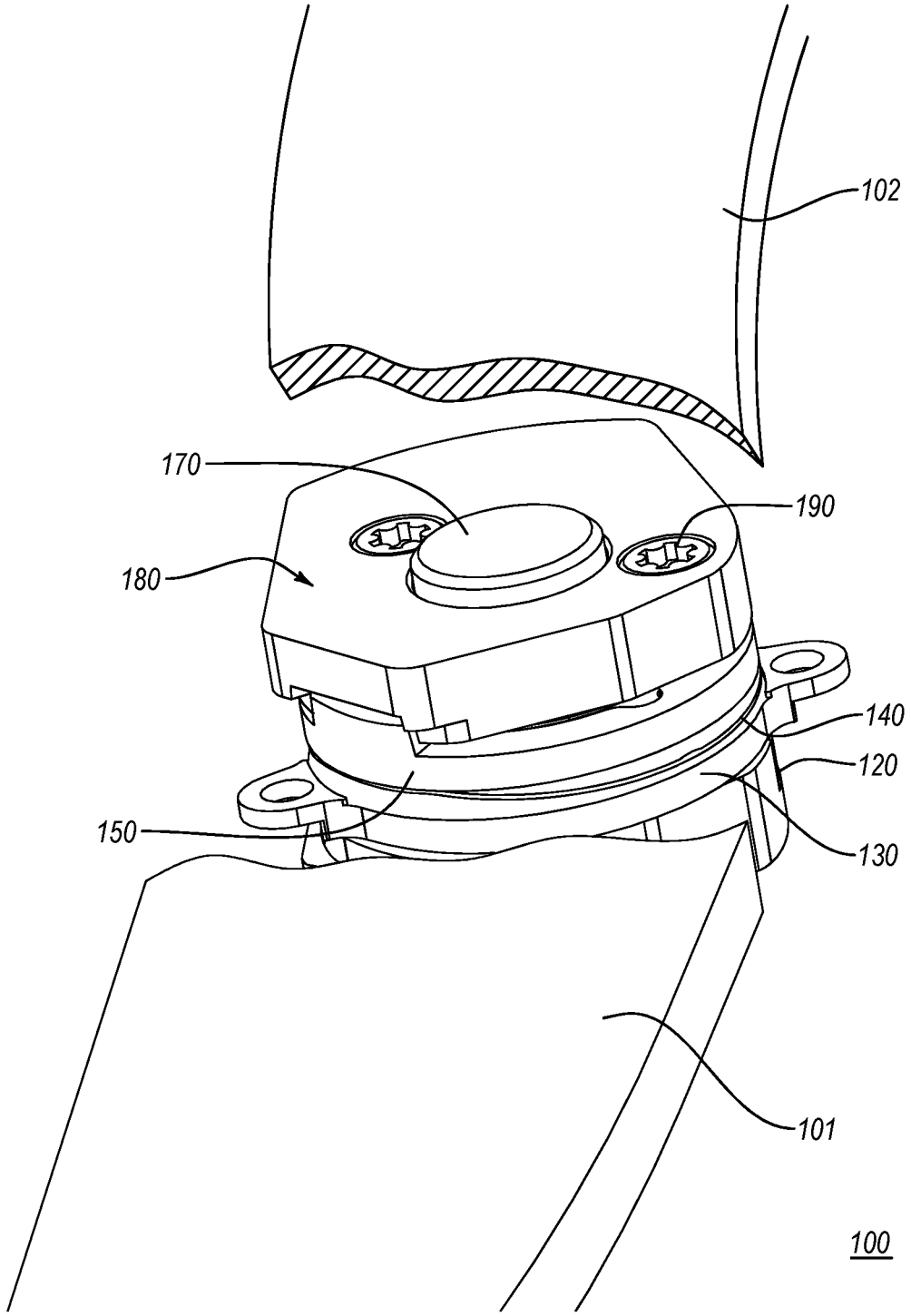
Figure 5C:
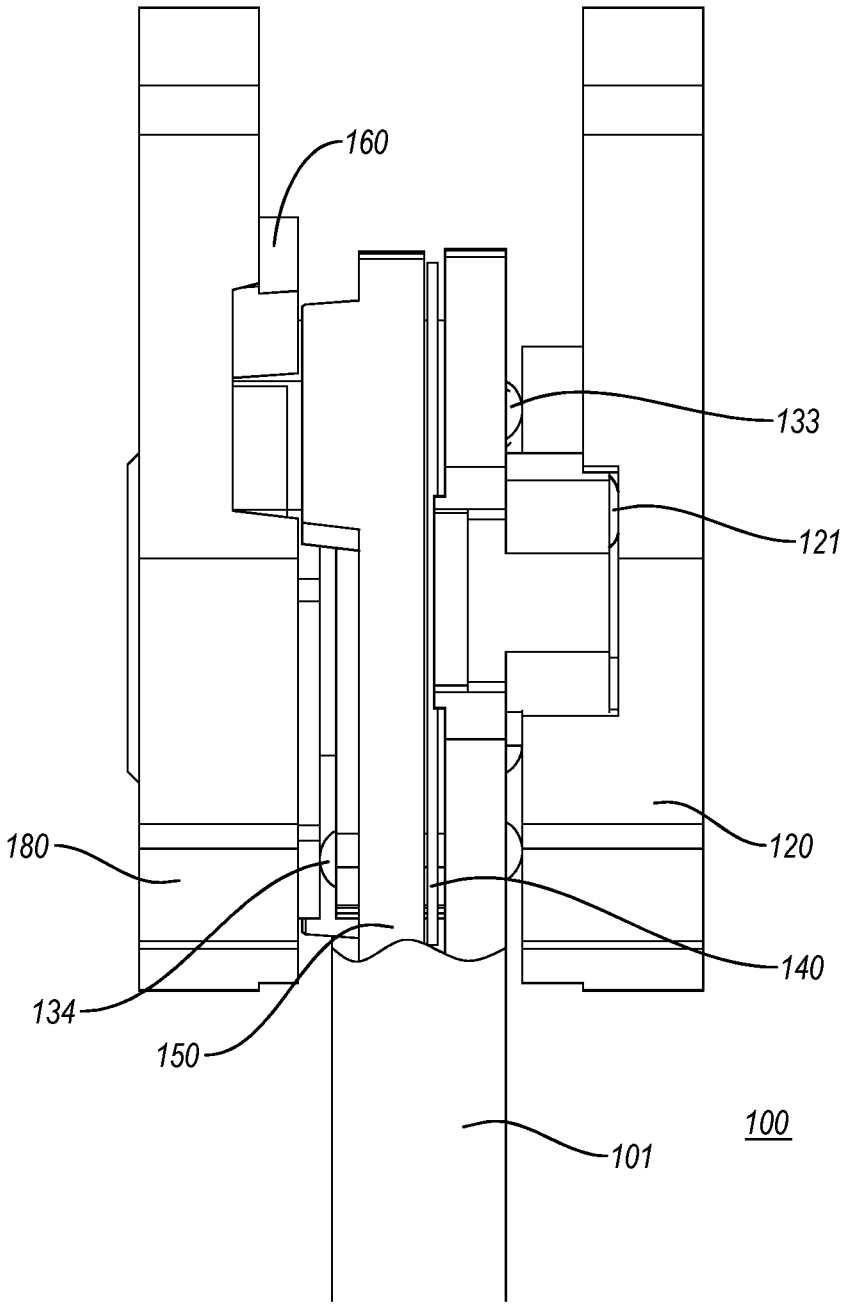

FIGS. 5A-5C illustrate views of the switch lock apparatus in an open blade position in a button push according to an embodiment.

FIGS. 5A-5C are illustrated with certain portions of certain components of the switch lock apparatus 100 cut-out (as indicated in the drawings by shading and/or recess showing the cut-out) to show other components that may be hidden. The handle portions 102 are not shown (e.g., as attached to the detent insert plate 120 and the female lock plate 180 in a fully assembled switch lock apparatus 100 on a knife) in FIGS. 5A and 5C.

During a button push (e.g., by a user), the protrusions 172 pushes on the protrusions 151 to release the protrusions 151 from the indents 186, thereby allowing the lock insert 150 (and the blade insert 130) to rotate (e.g., back to a close blade position).

In an embodiment, the switch lock apparatus 100 may be added as a replacement part to a knife or may be assembled as a part to a specifically designed knife. In other embodiments, the switch lock apparatus 100 may be used in other tools, other devices, or other mechanisms as known now or may be later derived that may benefit from an integrated switch lock functionality.

In an embodiment, the various components of the switch lock apparatus 100 may be heat-treated for strength and smoothness. Additionally, various surfaces of the components (e.g., the meeting surfaces) may be finished by lapping, machine-polishing, and/or other techniques as known now or may be later derived, for various look-and-feel of the switch lock apparatus 100 (e.g., satin finishing, blasting, polishing, and/or to match or complement the look-and-feel of the knife with the switch lock apparatus 100).

In an embodiment, the switch lock apparatus 100 may be cleaned by flushing with water, soapy water, and/or other suitable cleaners for the materials of the switch lock apparatus 100. For example, flushing can be completed using a spray based chemical cleaner, such as automotive Brake Cleaner, when the cleaner is suitable for a switch lock apparatus 100 may be made of stainless steel. In an embodiment, detailed cleaning may involve disassembly of the switch lock apparatus 100, individually cleaning each part, and then reassembly.

Oiling of the switch lock apparatus 100 may not be necessary, as relatively little to no heat is expected to be generated by operation of the switch lock apparatus 100, but oiling may be generally recommended. In an embodiment, the switch lock apparatus 100 may be oiled using a syringe oiler while installed in a knife by dropping oil in between the blade and handle spaces towards the mechanism. Oiling of deeper interior parts may be performed when the mechanism is disassembled. Generally, similar procedure for oiling a standard folding knife mechanism can be applied to this mechanism.

In an embodiment, replacement of components of the switch lock apparatus 100 that is installed in a knife may be performed through the following procedure: Disassembly of handles (e.g., handle portions 102) may be completed first (however they are assembled by the various manufacturers). The 8-32 screws (e.g., screws 110, 190, and other screws through openings 181 and 121) may be removed from the switch lock apparatus 100. This will separate the female lock plate 180 and the detent insert plate 120. The apparatus 100 will come apart. In an embodiment, the blade insert 130, the main spring 140, and the lock plate 150 are the designed failure and wear components. To replace these components, one would unscrew the blade insert 130 from a blade (e.g., blade 101) and remove those three components. New components may be installed in the blade and the apparatus 100 may be reassembled in reverse order.

EXAMPLE

Without intending to limit the scope of the invention, the following example illustrates how various embodiments of the invention may be made and/or used.

A prototype of an embodiment was made using machining techniques on stainless steel material. The prototype was tested for wear under regular operation, dynamic loading, weight holding, and failure testing. The switch lock mechanism of the prototype was a finished part which was tested in the soft state, with no heat treating performed to the components, except for the springs. This represents worst case scenario with maximum plastic deformation and wear.

Wear under regular operation: Testing of numerous openings and closing was performed under standard forces of use. The objective is to determine wear on the locking faces and compare that to industry standard. After approximately 500 openings and closings the parts wear inspected under magnification. After tests were completed the mechanism was disassembled and the wear characteristics that were observed showed the parts to have minimal change. Life expectancy of the parts would meet or exceed that of industry standard (e.g., about 100,000 openings) in this current state.

Dynamic loading: During use the lock will experience axial, radial, and torsion forces about the lock. This was tested by locking one part of a blade in a vise, and working the handle sections in different directions so as to impart dynamic forces on the lock mechanism. After tests were completed the mechanism was disassembled and the parts were inspected. Abnormal wear was not observed. Plastic deformation was also not observed.

In an embodiment, the switch lock mechanism is designed so that the lock plate has the ability for float. When forces change and non-plastic deformation takes place under use, the lock plate is able to move and compensate for changes. The locking faces will stay engaged.

Weight holding: Maximum torque that the mechanism can withstand was tested. This test was performed with the mechanism mounted in a blade and handle. The weight was attached to both the blade and handle and the respective moment forces were calculated. The resulting torque of 878 in lbs was the maximum torque obtained where the lock still functioned. Plastic deformation was noted on the locating bosses of the lock plate, as well as on the locking faces.

The test was continued until failure to test one of the design features of the lock. The modularity of the locking mechanism is specifically designed so that under failure components can be changed in the locking mechanism, instead of changing out other parts of the completed system (blades and handles in a knife, or other critical system parts in a non-knife application).

Failure testing: The lock was made to fail using a moment force greater than 878 in lbs. The failure resulted in shearing of the locating bosses for the lock plate, which is a designed in failure point. This failure causes one of the system parts to be allowed to rotate. After failure the system was taken apart. The blade insert and lock plate were replaced, and the mechanism was reassembled. After this assembly the mechanism was put back into use.

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing discussion has been presented for purposes of illustration and description. The foregoing is not intended to limit the disclosure to the form or forms disclosed herein. In the foregoing description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this description, with each claim standing on its own as a separate preferred embodiment of the disclosure.

Moreover, though the description has included a description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A modular switch lock apparatus, comprising:

an insert plate;

a blade insert;

a spring;

a lock plate;

a bottom plate;

a button; and a lock insert, wherein the insert plate and the bottom plate are axially aligned, wherein the spring separates a top surface of the lock plate and a bottom surface of the blade insert, wherein the blade insert and the lock plate are rotationally coupled, wherein the bottom plate includes a space for lodging a portion of the lock plate, wherein the lock plate is rotationally coupled with the bottom plate when the portion is lodged in the space, wherein the lock plate is rotationally movable with respect to the bottom plate when the portion is not lodged in the space, wherein the button is rotationally coupled to the bottom plate, wherein the button is operable to dislodge the portion from the space, and wherein the lock insert is rotationally coupled to the insert plate, the bottom plate, and the button.

2. The modular switch lock apparatus of claim 1, wherein the blade insert is attached to a blade portion of a knife, and wherein at least one of the insert plate and the bottom plate is attached to a handle portion of the knife.

3. The modular switch lock apparatus of claim 1, wherein the portion comprises a protrusion and the space comprises a corresponding indent fitting the protrusion, wherein a mouth of the corresponding indent for fitting a base of the protrusion is longer than a base of the corresponding indent for fitting a tip of the protrusion.

4. The modular switch lock apparatus of claim 1, wherein, in a configuration, the blade insert is rotationally coupled to the insert plate, and wherein, in the configuration, the portion is not lodged in the space.

5. The modular switch lock apparatus of claim 4, wherein, in a second configuration between the blade insert and the insert plate, the blade insert is rotationally movable with respect to the insert plate, and wherein the configuration is switchable to the second rotational configuration through an application of a force.

6. The modular switch lock apparatus of claim 5, further comprising a third spring and a bearing lodged in a second space of the blade insert, wherein, in the configuration, the bearing is lodged in a third space of the insert plate.

7. The modular switch lock apparatus of claim 1, further comprising first and second sets of one or more bearings, wherein the first set facilitate rotation between the insert plate and the blade insert, and wherein the second set facilitate rotation between the bottom plate and the blade insert.

8. A modular switch lock apparatus, comprising:

an insert plate;

a blade insert;

a spring;

a lock plate; and a bottom plate, wherein the insert plate and the bottom plate are axially aligned, wherein the spring separates a top surface of the lock plate and a bottom surface of the blade insert, wherein the blade insert and the lock plate are rotationally coupled, wherein the bottom plate includes a space for lodging a portion of the lock plate, wherein the lock plate is rotationally coupled with the bottom plate when the portion is lodged in the space, and wherein the lock plate is rotationally movable with respect to the bottom plate when the portion is not lodged in the space, and wherein the portion comprises a protrusion and the space comprises a corresponding indent for fitting the protrusion, wherein at least one of an edge of the protrusion and an edge of the corresponding indent is tapered.

9. The modular switch lock apparatus of claim 8, wherein the switch lock mechanism further comprises a button, wherein the button is rotationally coupled to the bottom plate, and wherein the button is operable to dislodge the portion from the space.

10. The modular switch lock apparatus of claim 8, wherein, in a configuration, the blade insert is rotationally coupled to the insert plate, and wherein, in the configuration, the portion is not lodged in the space.

11. The modular switch lock apparatus of claim 10, wherein, in a second configuration between the blade insert and the insert plate, the blade insert is rotationally movable to the insert plate, and wherein the configuration is switchable to the second configuration through an application of a force.

12. The modular switch lock apparatus of claim 11, wherein the switch lock mechanism further comprises a second spring and a bearing lodged in a second space of the blade insert, wherein, in the configuration, the bearing is lodged in a third space of the insert plate.

13. The modular switch lock apparatus of claim 9, wherein the switch lock mechanism further comprises a lock insert rotationally coupled to the insert plate, the bottom plate, and the button and a second spring between the button and the lock insert.

14. The modular switch lock apparatus of claim 8, wherein the switch lock mechanism further comprises first and second sets of one or more bearings, wherein the first set facilitate rotation between the insert plate and the blade insert, and wherein the second set facilitate rotation between the bottom plate and the blade insert.

15. A folding knife, comprising:

a blade portion;

a handle portion; and a switch lock mechanism, wherein the switch lock mechanism comprises an insert plate;

a blade insert;

a spring;

a lock plate;

a lock insert;

a button; and a bottom plate, wherein the insert plate and the bottom plate are axially aligned, wherein the spring separates a top surface of the lock plate and a bottom surface of the blade insert, wherein the blade insert and the lock plate are rotationally coupled, wherein the bottom plate includes a space for lodging a portion of the lock plate, wherein the lock plate is rotationally coupled with the bottom plate when the portion is lodged in the space, wherein the lock plate is rotationally movable with respect to the bottom plate when the portion is not lodged in the space, wherein the button is rotationally coupled to the bottom plate, wherein the button is operable to dislodge the portion from the space, and wherein the lock insert rotationally coupled to the insert plate, the bottom plate, and the button, wherein the blade insert is attached to the blade portion, and wherein at least one of the insert plate and the bottom plate is attached to a handle portion of the knife.

16. The folding knife of claim 15, wherein, in the configuration, the blade portion is in an open position with respect to the handle portion.

17. The folding knife of claim 15, wherein, when the portion is lodged in the space, the blade portion is in a closed position with respect to the handle portion.

18. The folding knife of claim 15, wherein the switch lock mechanism further comprises first and second sets of one or more bearings, wherein the first set facilitate rotation between the insert plate and the blade insert, and wherein the second set facilitate rotation between the bottom plate and the blade insert.

19. The folding knife of claim 15, wherein the portion comprises a protrusion and the space comprises a corresponding indent fitting the protrusion, wherein at least one of an edge of the protrusion and an edge of the corresponding indent is tapered.

20. The modular switch lock apparatus of claim 8, wherein both the edge of the protrusion and the edge of the corresponding indent is tapered.

* * * * *